US006071145A

United States Patent [19]

Toly

[11] Patent Number: 6,071,145

[45] Date of Patent: Jun. 6, 2000

[54] CONTACT HOUSING FOR ELECTRICAL CONNECTOR

[76] Inventor: Elde V. Toly, 109 Bulkley Ave., Sausalito, Calif. 94965

[21] Appl. No.: 09/241,219

[22] Filed: Feb. 1, 1999

[51] Int. Cl.[7] ..... H01R 13/00

[52] U.S. Cl. ..... 439/485; 439/465; 439/750

[58] Field of Search ..... 439/485, 465, 439/470, 731, 732, 750, 814, 889, 825

[56] References Cited

U.S. PATENT DOCUMENTS

| | | | |
|---|---|---|---|
| 3,856,376 | 12/1974 | Poliak et al. | 339/107 |
| 5,234,358 | 8/1993 | Polgar | 439/465 |
| 5,423,692 | 6/1995 | Francis | 439/335 |

*Primary Examiner*—Steven L. Stephan
*Assistant Examiner*—Amir M. Abdulmelik
*Attorney, Agent, or Firm*—Owen, Wickersham & Erickson, P.C.

[57] ABSTRACT

A protective housing for an elongated metal connector attached to the end of an electrical conductor wherein the connector comprises a tubular portion at its rear end for receiving the conductor and a contact portion at its forward end. The protective housing comprises a bottom section of rigid non-conductive material having a semi-cylindrical portion and a forward tubular portion for holding the metal connector. A top section of the housing fits against and is secured to the semi-cylindrical portion of the bottom section to form the assembled protective housing. Internal members within the top and bottom portions are adapted to engage the outer surface of the metal connector and provide heat insulgating air spaces around the metal connector within the assembled housing.

12 Claims, 6 Drawing Sheets

CONTACT HOUSING FOR ELECTRICAL CONNECTOR

This invention relates to electrical connection devices and more particularly it relates to an improved housing for surrounding the terminal end connector used on a relatively heavy electrical conductor.

BACKGROUND OF THE INVENTION

In many industrial activities where heavy electrical loads are utilized, it is necessary to provide adequate cable end connectors which must not only be safe in operation but should also be relatively easy to manipulate with minimal labor and time requirements. A common form of heavy cable electrical connector comprises a generally cylindrical metal member having a tubular portion at its rear end to receive the end of the cable conductor. The metal conductor, inserted in the tubular portion at one end of the connector is held in place by set screws extending through the side of the connector. The forward end of the metal connector has either a male or female extension so that it can connect with a similar metal connector having a mating male or female connector. Such mating metal connector pairs are connected by an axial movement followed by relative twisting and are commonly known in the field as cam-lock connectors. For obvious reasons it is necessary to provide an insulating housing or covering around each connector. Heretofore, such coverings were made from rubber or thermo-plastic sleeve-like devices called shrouds which fit closely around the metal connector. Such prior art insulating devices were cumbersome, inefficient and particularly difficult to install using time-consuming procedures.

In order for the connector shroud to be effective it was necessary for it to restrict both axial and rotational movement of the connector inside the shroud. With prior art shrouds this was accomplished by: (1) locating a protrusion or stud that projected from the side of the connector into a solid recess inside the shroud; or (2) by driving a screw through the shroud and into the connector. Both of the aforesaid methods presented serious difficulties. In the first method it was difficult to locate the connector stud as the shroud was pulled over the connector. This was a critical problem because improper assembly of the shroud resulted in free rotational movement of the connector within the shroud. Also, it was impossible without special tools to remove the connector from the shroud to repair or replace it in the field. Thus, the alternative procedure was to cut away and destroy the old shroud and replace it with a new one. In the second method it was necessary during the assembly of the shroud to align a through hole in the shroud, for the screw, with a threaded hole in the connector. An insulated head was required on the screw so that no raw metal would be exposed on the shroud, but such heads were subject to breakage and created a potential shock hazard.

Another difficulty with prior art shrouds used in both of the aforesaid assembly methods was that they were designed to fit close around the metal connector. Thus, these tubular shrouds were made somewhat smaller than the connector and had to be stretched when installed. Often, grease was applied to the cables to enable the shroud to be pulled into position over the connector. Also, for both of the prior installation methods, it was often necessary to cut the shrouds to suit a particular cable size and this resulted in an imprecise mating of the shroud exit with the cable jacket. Since the prior art shrouds were close to the connector surface, they often tended to over-heat due to high current flow and, in some instances failed to provide adequate protection to users.

A general object of the present invention is to provide an insulating housing for cam-lock metal connectors used on heavy electrical conductors that solves the aforesaid problems.

A more specific object of the invention is to provide an insulating housing for electrical cam-lock connectors that is easy to install in a relatively short period of time without the need for special tools or skilled labor.

Other objects of the invention are to provide a rigid insulating housing for electrical cam-lock connectors that: (1) retains the connector firmly within the housing so that it can have no axial or rotational movement relative to the housing; (2) provides for a heat dissipating air space around the metal connector within the housing that prevents the housing from overheating; (3) provides for removable cable gripping inserts that prevents the cable from applying any torsion loads on the connector; (4) provides a means for sealing the connector within the housing to prevent moisture penetration when the latter is installed.

SUMMARY OF THE INVENTION

The aforesaid and other objects of the invention are accomplished by a two-piece housing comprising a lower section and an upper cap section which are preferably molded from a suitable plastic material such as an extra hard nylon. The larger, lower housing section has a semi-cylindrical portion and an integral tubular forward end portion that forms either a male or female connector for a mating connector housing. The interior of the lower housing section has a series of spaced apart integral arcuate rib portions that provide specific functions and features. Extending axially between and perpendicular to the arcuate rib portions is a slot which is only slightly wider than a projecting stud member on the metal connector. Some of the arcuate portions constitute internal ribs that are sized to form a supporting cradle for the metal connector that fits within the housing. Between these ribs are air spaces that provide a heat dissipation envelope around the metal connector. Near the open end are integral portions forming an arcuate groove for an elastomeric sealing ring. Another pair of ribs forms a seat for a cable gripping insert which functions with a similar insert in the cap member to hold the cable firmly when the two-piece housing is assembled. On opposite sides of both sections are boss portions adapted to receive screws for holding the cap section in place on the lower housing section. When the housing is assembled, a metal connector which has been attached to an electrical cable is inserted into the lower housing section with its stud member in the axial slot and its front end extending into the tubular portion of the lower housing section. As the connector is moved forward an annular shoulder bears against the tubular forward end of the lower housing section. The upper cap section is then positioned on the lower housing section and is attached thereto by four screws. Thus, the metal connector is held firmly by the internal ribs within the assembled housing. A mating connector having a housing with a mating frontal portion can be attached by first axially connecting the two connectors and the surrounding housings and then twisting the housing to cam-lock the connectors therein. Simultaneously, the forward mating portion of one housing fits within the forward portion of the adjoining housing.

Other objects, advantages and features of the invention will become apparent from the following detailed description of an embodiment of the invention, presented in conjunction with the accompanying drawing.

DETAILED DESCRIPTION OF EMBODIMENT

Figure 1:
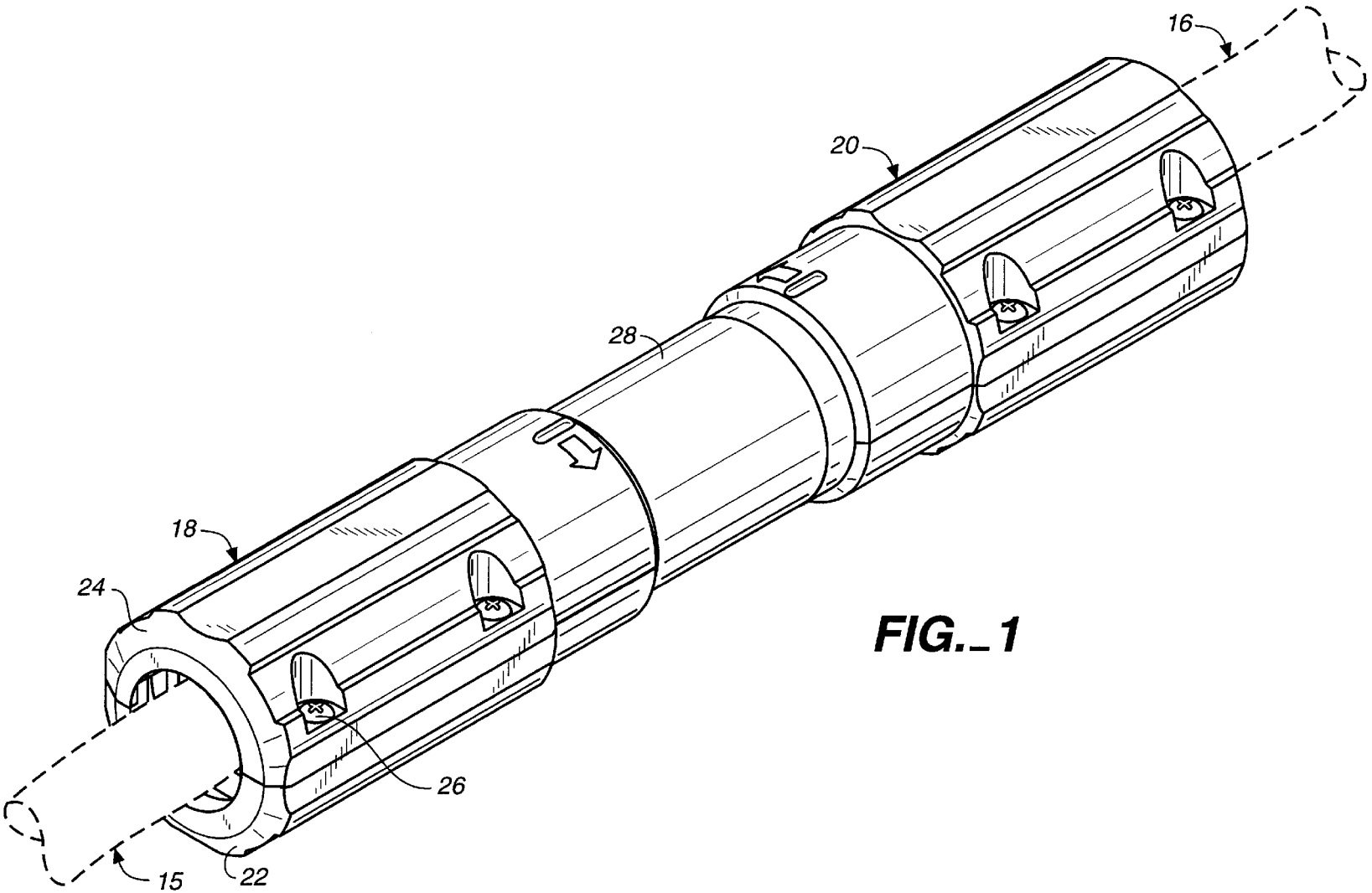
FIG. 1 is a view in perspective of an electrical conductor connection utilizing terminal connector housings embodying principles of the present invention.

With reference to the drawing, FIG. 1 shows a pair of high voltage cables 15 and 16 connected by a pair of metal cam-lock contact connectors (See FIG. 3) that are seated within and surrounded by a pair of male and female contact connector housings 18 and 20 embodying principles of the present invention.

Figure 2:
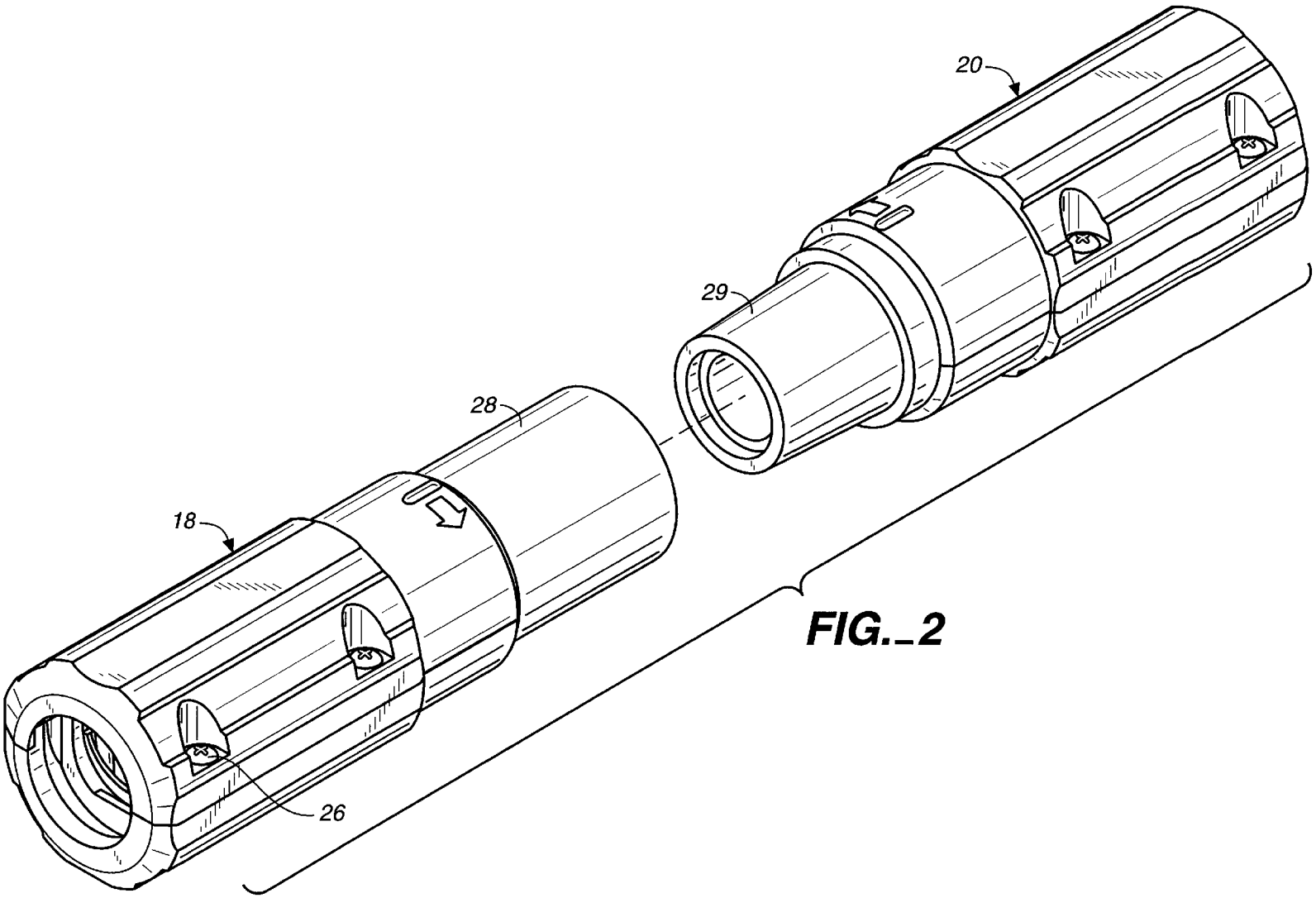
FIG. 2 is a view in perspective showing the terminal connector housing of FIG. 1 in line but separated.

In FIG. 2, the connector housings 18 and 20 are shown apart without the cables attached. Each connector housing comprises a main or lower housing section 22 and an upper or cover section 24 which is attached to the main section by a series of screws 26. Both housing sections are made from a suitable non-conductive, plastic material such as a relatively hard nylon material, preferably utilizing an injection molding procedure well known to those skilled in the art.

The two connector housings 18 and 20 are essentially identical except for their tubular forward portions. The housing 18 has a female forward portion 28 that is larger than and is adapted to receive, with a close sliding fit, a male forward portion 29 on the connector housing 20.

Figure 4:
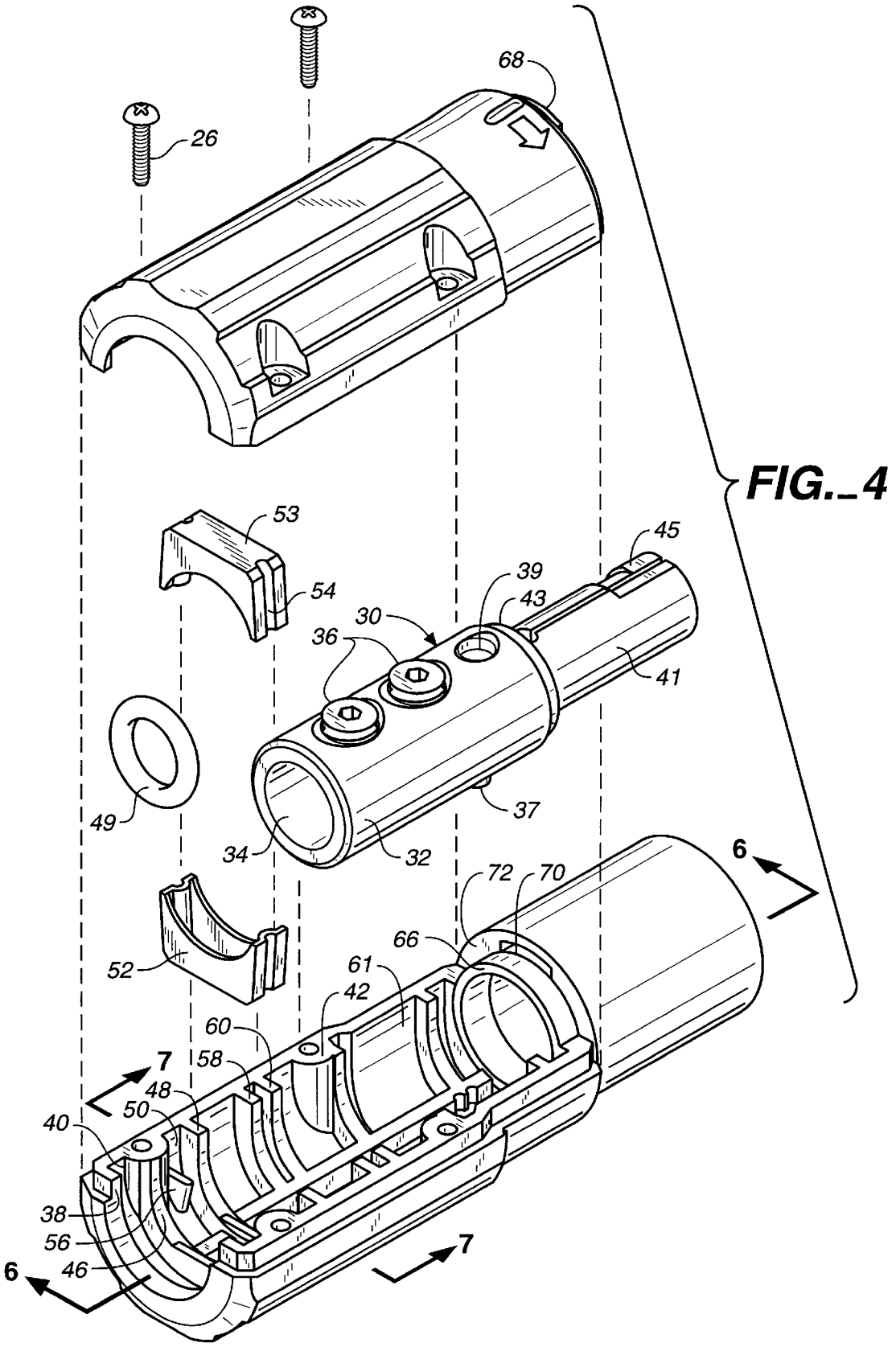
FIG. 4 is an exploded view in perspective showing an electrical connector housing embodying principles of the present invention together with an electrical connector that fits within the housing.
Figure 10:
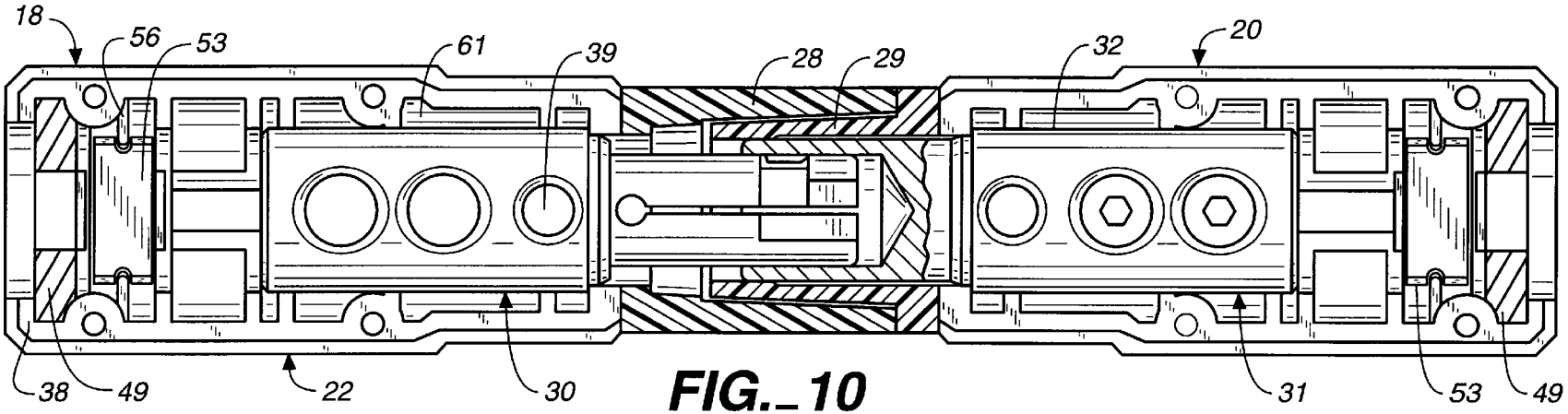
FIG. 10 is a plan view partially in section showing a pair of housings and their enclosed electrical connectors joined together.

The female connector housing 18 is shown in greater detail in FIG. 4 which depicts the lower housing section 22 separated from the upper housing section 24 with a male metal connector 30 shown between them. As shown in FIG. 10, a female metal connector 31 is normally enclosed by a male connector housing 20.

Figure 3:
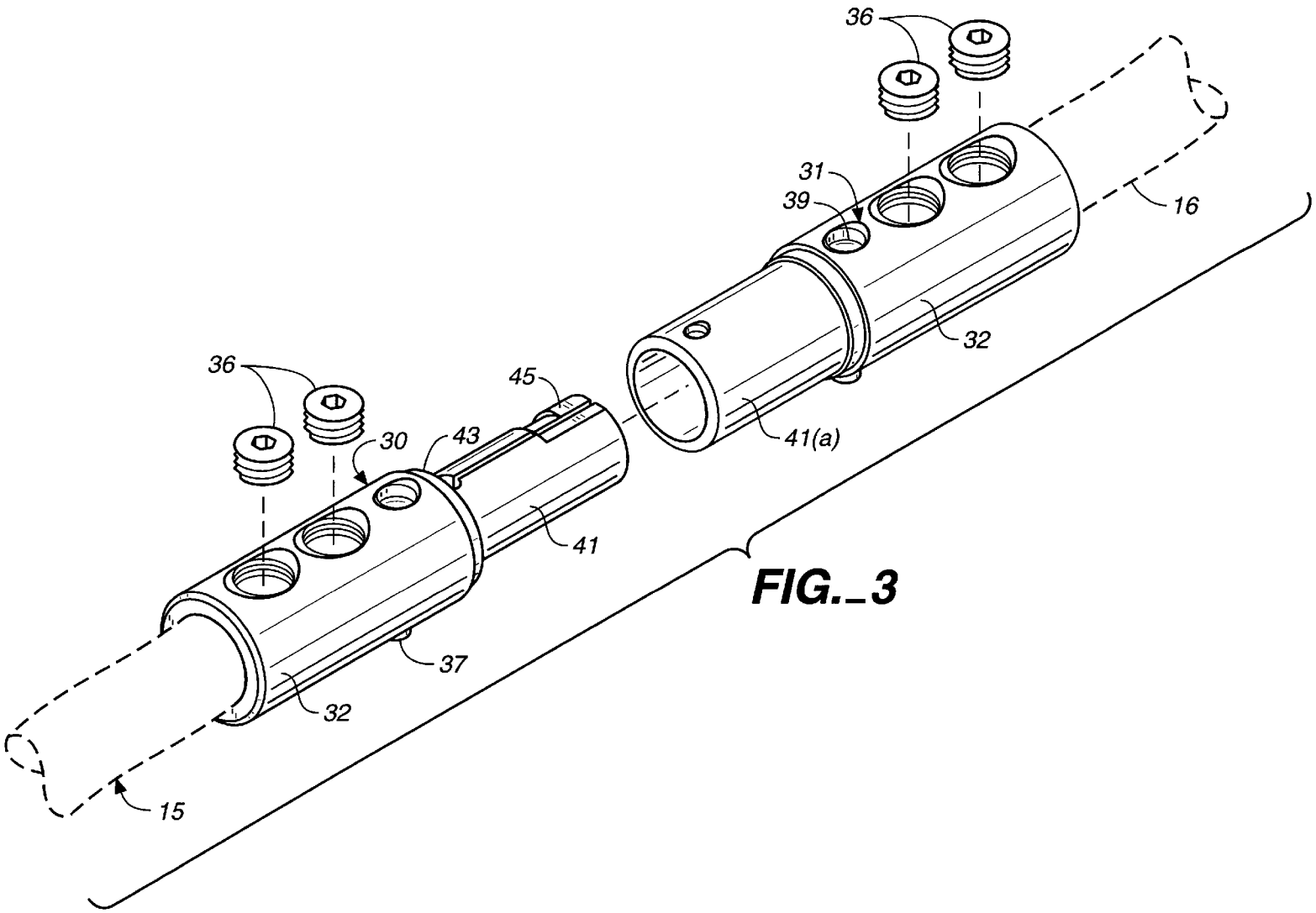
FIG. 3 is a view in perspective showing standard electrical connectors for adapted for being attached to the ends of electrical conductors.

The metal contact connector 30, as shown in FIG. 3, which has been used extensively in electrical wiring circuits heretofore, comprises a metal (e.g. copper or brass) fitting having a generally cylindrical shape with a tubular portion 32 forming a cylindrical cavity 34 at one end. The cavity is adapted to receive the conductive core of the cable 0.5 and when inserted into the cavity, the conductive core is held in place by a pair of set-screws 36 which are seated within the tubular portion 32 and extend into the cavity 34. Near the forward end of the tubular portion 32 is a radially extending stud member 37. On the opposite side of the connector from the stud 37 is a recess or detent hole 39. Integral with the tubular portion 32 is a solid forward portion 41 of the connector 30 having a smaller diameter that constitutes a male connector member and forms an annular shoulder 43 between the two portions. At the outer end of the forward portion is a cutaway area forming a flat surface 45 that is shaped to form a well known twist lock connection with a mating female connector 31. The female connector 31 is identical to the male connector 30 except that it has a forward tubular portion 41(*a*) that is sized to receive the forward portion 41 of the male connector 30. (See FIG. 10) When the contact connector 30 and 31 are joined, the male forward portion 41 fits into the female portion 41(*a*) and the two are locked in place by a relative twisting action.

Figure 8:
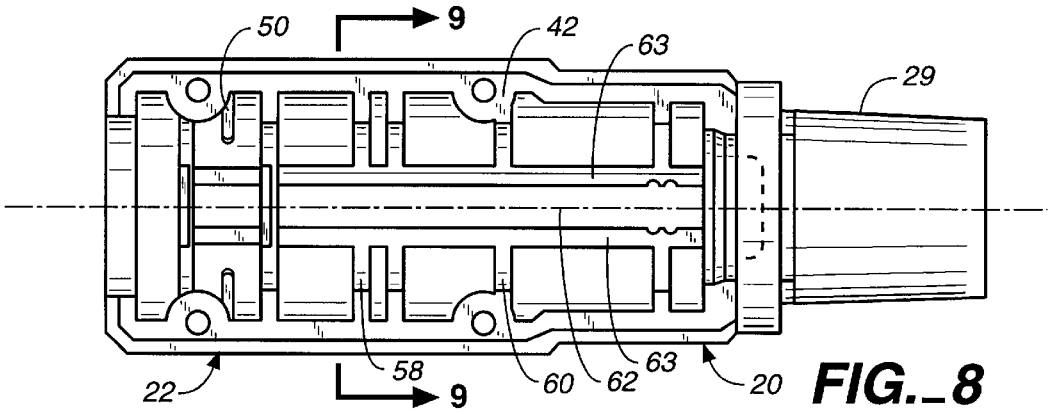
FIG. 8 is a plan view showing the internal structure of a bottom housing section.

The lower housing section 22, as shown in FIGS. 4 and 8, is formed with a series of integral rib-like projections which have semi-cylindrical edges for engaging the outer surface of a metal connector 30 or 31.

Figure 5:
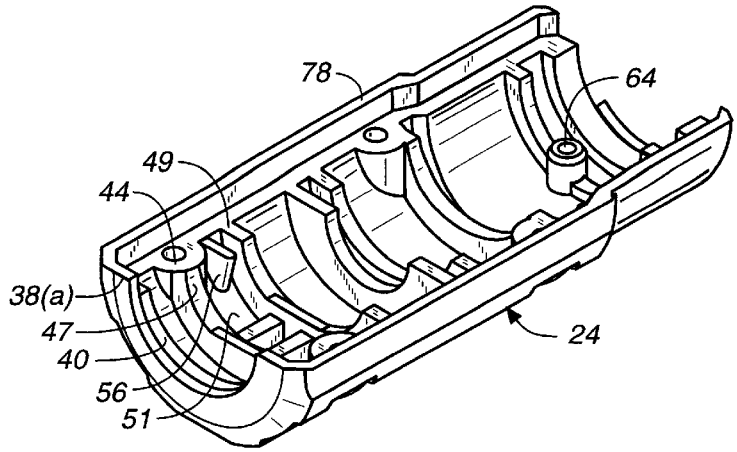
FIG. 5 is a view in perspective showing one portion of the housing of FIG. 4.
Figure 6:
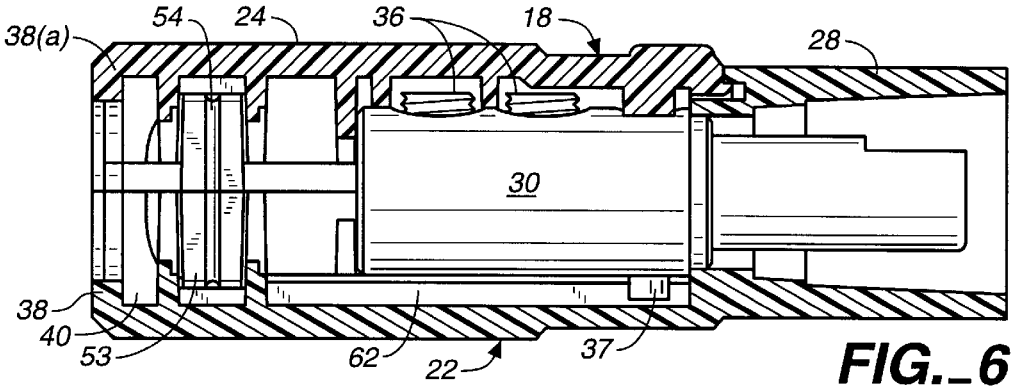
FIG. 6 is a view in elevation and in section of the housing of FIG. 4 with an electrical connector installed therein, taken along line 6—6 of FIG. 4.

As shown in FIG. 5, the upper housing section 24 has a similar series of integral rib portions and projections that match and cooperate with those of the lower housing section so that the two sections fit precisely together to form a fluid tight protective housing for connector 30 or 31.

At the open end of the lower housing section 22 through which an insulated cable extends is an outer lip portion 38 that forms an arcuate end groove 40 within which can be seated an elastomeric sealing ring 49 (FIG. 10). A similar lip portion 38(*a*) is provided on the upper housing section 24 to form a matching portion for the groove 40.

On the lower housing section 22, as shown in FIG. 4, are four spaced apart bosses 42 with threaded holes, and on the upper housing section are similarly spaced apart bosses 44, (FIG. 5) also with threaded holes. When the two housing sections are together, the holes of the two sets of bosses 42 and 44 are aligned to receive the attaching screws 26.

Spaced inwardly from the end groove 40 is a pair of ribs 46 and 48 on the lower housing sections that provide a second groove 50 which forms a seat for a removable clamp member 52, as shown in FIG. 4. A similar pair of ribs 47 and 49 in the upper housing section, as shown in FIG. 5, form a matching groove 51 for a mating clamp member 53. The clamp members 52 and 53 each have narrow grooves 54 on their opposite sides which are engaged by aligning projections 56 located within the grooves 50 and 51 of the lower and upper housing sections respectively. When each clamp member 52 and 53 is inserted within its respective groove 50 and 51, the projections 56 fit within their side grooves 54 of the clamp members 52 and 53 and hold them in perfect alignment. When the upper and lower housing sections 22 and 24 are held together with their respective clamp members 52 and 53 in place, the latter having inner arcuate surfaces which serve to grip the cable firmly and thereby prevent it from moving relative to the housing despite any external twisting or tensile forces that may be applied. The clamp members may be provided with inner arcuate surfaces of various degrees of curvature in order to accommodate different cable sizes.

Additional spaced apart internal rib portions 58 and 60 are provided within the lower and upper housing sections 22 and 24 which support the tubular portion of the connector and form air spaces 61 between the rib portions. Thus, a layer or envelope of air surrounds the metal connector 30 or 31 within its enclosed housing and provides a heat dissipating insulation envelope that protects the housing assembly from excessive heat build-up.

Another feature provided in the lower housing section 22 of each connector housing, as shown in FIG. 10, is an elongated, axially extending slot or groove 62 formed by a pair of longitudinal ribs 63 that extend along the bottom of the lower housing section 24. This groove 62 is adapted to receive the stud member 37 which extends from the side of the metal cam-lock connectors 30 and 31.

On the inside of the upper housing member 24 near its front end, as shown in FIG. 5, is an integral projection 64 which is sized to fit within the recess 39 of the connector 30 or 31 when the housing sections are assembled.

Contrary to the difficulties of the prior art shroud devices, the housings 18 and 20 provide a rigid, insulative, protective covering for the electric connectors 30 and 31 which enables the safe, easy connection of electrical cables used in various applications. Describing now the simple assembly of a connector 30 and its housing 18, a cable conductor is first attached to the connector 30 in the conventional manner, by inserting the cable conductor 15 into the cylindrical cavity 34 of the connector 30 and tightening the set screws 36. The connector 30 with its attached cable is now ready to be inserted into the housing 18. First, the stud member 37 on the connector is placed in the slot 62. The connector is then pushed forwardly with its solid forward portion 41 extending into the tubular forward portion 28 of the housing. When the annular shoulder 43 of the connector bears against and is stopped by an annular face 66 (FIG. 4) on the lower housing section 22, the connector is in its proper and fully seated position. Prior to installation of the connector into the lower housing member, a pair of gripping members 52 and 53 of the proper size have been inserted into their respective seats in the lower and upper body sections. Also, prior to the connection of the cable to the connector, an elastomeric donut shaped sealing ring 49 is placed around the cable and seated in the annular groove 40. Now, the upper housing section 24 can be attached to the lower housing section by the screws 26. As the upper housing section is moved into place, a small projecting lip 68 on its forward end fits into an arcuate slot 70 in an arcuate transverse face 72 on the lower housing section 22. Also, as previously mentioned, the projection 64 fits into the connector recess 39 as the upper housing section 24 is attached.

Figure 7:
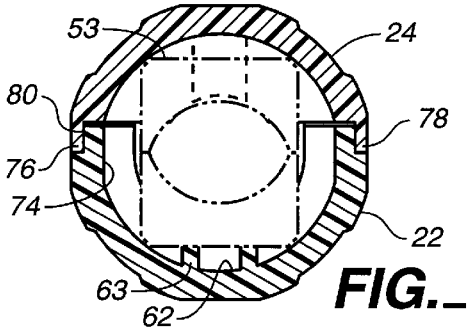
FIG. 7 is a view in section taken at line 7—7 of FIG. 4.
Figure 9:
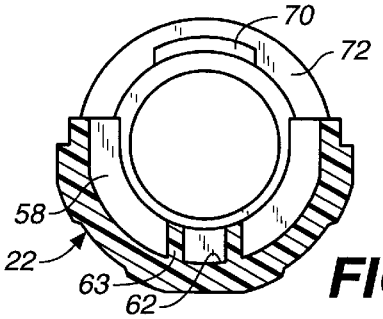
FIG. 9 is a view in section taken along line 9—9 of FIG. 8.

Along the sides each housing 18 and 20 where the upper housing section abuts the lower housing section, a leak-proof joint is formed, as shown in FIG. 7. The lower housing section 22 has recessed side flanges 74 which are located inwardly from its outer surface, and these flanges extend above a horizontal peripheral ledge 76. The upper housing section 24 has outer peripheral flange portions 78 that extend above inner contact surfaces 80. When the upper housing section is attached to the lower housing section, the flange portions 78 of the upper section overlap the side flanges 74 of the lower section and are drawn against the peripheral ledge 76 of the lower housing section and the side flanges 74 bear against the surfaces 80. A suitable gasket material (not shown) is provided between the flanges 74 and contact surfaces 80 to assure a leak proof assembly.

Once the upper housing member 24 is firmly attached to the lower housing section 22, the connector 30 therein is fully locked in place. The connector is thus completely isolated electrically, and the envelope of air surrounding the connector eliminates an over-heating problem. If any repair or replacement of the connector 30 is required, the housing 18 can be quickly disassembled with only a screwdriver.

In a typical cable connection, as shown in FIG. 10, a male connector 30 is contained within a female housing 18, and a female connector 31 is within a male housing 20. When two housings 18 and 20 are connected, the cam-lock ends of the mating connectors 30 and 31 within the housings will readily engage and be locked in place by the usual twisting motion. Simultaneously, the tubular portion 29 of the housing 20 fits within the female tubular portion 29 of the housing 18. The engaged connector portions are thus completely enclosed within the mating tubular forward portions of the connected housings 18, and the current carrying connectors are completely isolated.

To those skilled in the art to which this invention relates, many changes in construction and widely differing embodiments and applications of the invention will make themselves known without departing from the spirit and scope of the invention. The disclosure and the description herein are purely illustrative and are not intended to be in any sense limiting.

What is claimed is:

1. A protective housing for retaining an elongated metal connector attached to the end of an electrical conductor, said connector comprising a tubular portion at its rear end adapted for connecting with said conductor, a stud member projecting from said tubular portion, and a male or female contact portion extending forwardly from said tubular portion, said protective housing comprising:

a bottom section of rigid non-conductive material having a semi-cylindrical portion and a forward tubular portion;

a semi-cylindrical top section adapted to fit against said semi-cylindrical portion of said bottom section to form a protective enclosure for said connector;

means for securing said top section to said bottom section; and rib means within said top and bottom portions for engaging the outer surface of said metal connector while providing heat insulating air spaces around said metal connector within said housing; and retaining means in said housing sections for holding said connector in place so as to prevent any axial or rotational movement of said connector within said housing.

2. The protective housing as described in claim 1 wherein said bottom and top section are molded as integral components from a relatively hard plastic material.

3. The protective housing as described in claim 2 wherein said plastic material is a hard nylon.

4. The protective housing as described in claim 1 wherein said bottom section and said top section each have internal boss portions with threaded holes, and said means for securing comprises a plurality of screws which extend through said top section bosses into said bottom section bosses.

5. The protective housing as described in claim 1 including removable insert means retained by said rib means within said bottom and top sections for gripping the electrical conductor attached to said connector to prevent the conductor from transmitting any torsion force to said connector when said bottom and top sections are secured together.

6. The protective housing as described in claim 5 wherein said insert means comprises a first member retained in said bottom section having an arcuate surface adapted to engage said conductor, and a similar second member retained within said top section.

7. The protective housing as described in claim 6 wherein each said insert means fits between a pair of said rib means and alignment means between each said pair of rib means for engaging said insert means.

8. The protective housing as described in claim 6 wherein said rib means includes an end rib near one end of said housing for retaining an elastomeric sealing ring adapted to fit around said conductor.

9. The protective housing as described in claim 1 wherein said retaining means comprises an axially extending slot in said bottom section for receiving and confining said connector stud member to prevent rotational movement of said connector within said housing.

10. The protective housing as described in claim 9 wherein said connector further includes a recess on the opposite side of its tubular portion from said stud member, and an integral projection near one end of said top section adapted to fit within said recess to prevent axially or rotational movement of said connector with the assembled housing.

11. The protective housing as described in claim 1 wherein said forward tubular portion on said bottom housing section is sized to form a slidable fit with a forward tubular portion of a mating protective housing.

12. The protective housing as described in claim 1 wherein said protective housing has a forward tubular position forming a female receptacle with a larger diameter than the forward portion of a mating protective housing, and is adapted to retain a metal connector having a male type forward portion.

* * * * *